US006082493A

United States Patent [19]

Mason

[11] Patent Number: 6,082,493

[45] Date of Patent: Jul. 4, 2000

[54] METHOD AND APPARATUS FOR SUSPENDING WORKER'S SCAFFOLDS OVER THE SIDES OF BUILDINGS

[76] Inventor: Dennis P. Mason, 1470 SW. Borland Rd., West Linn, Oreg. 97068

[21] Appl. No.: 09/075,268

[22] Filed: May 8, 1998

[51] Int. Cl.[7] ..... E04G 1/18

[52] U.S. Cl. ..... 182/145; 182/37; 182/142; 182/150

[58] Field of Search ..... 182/142, 145, 182/147, 150, 36, 37, 129; 52/708; 240/544

[56] References Cited

U.S. PATENT DOCUMENTS

| | | | |
|---|---|---|---|
| 4,270,628 | 6/1981 | Anderson | 182/37 X |
| 4,454,928 | 6/1984 | Marteau et al. | 182/142 X |
| 4,538,705 | 9/1985 | Leivestad | 182/142 |
| 4,545,558 | 10/1985 | Crudele | 182/142 X |
| 4,598,524 | 7/1986 | Cheng | 52/708 |
| 4,714,226 | 12/1987 | Tracy | 240/544 |
| 4,811,819 | 3/1989 | Sugiyama | 182/37 |
| 5,065,838 | 11/1991 | Finley | 182/150 X |
| 5,341,898 | 8/1994 | Baziuk | 182/142 |
| 5,343,979 | 9/1994 | Goto | 182/147 |
| 5,498,011 | 3/1996 | Kilada et al. | 182/142 X |
| 5,664,391 | 9/1997 | Bartholomew | 182/150 X |
| 5,713,430 | 2/1998 | Cohen | 182/142 X |

*Primary Examiner*—Daniel P. Stodola
*Assistant Examiner*—Bruce A. Lev
*Attorney, Agent, or Firm*—Robert L. Harrington

[57] ABSTRACT

An apparatus for attachment of a davit mount for holding a scaffolding over the side of a building attaches directly to a structural column of the building, and eliminates the need for both a safety anchor located atop and within the roof inwardly from the roof edge, and a safety line extending back to that safety anchor. Because of the indicated apparatus, the structural integrity of the roof surface need not be compromised in order to install that safety anchor, and secondly no safety line remains extended over any portion of the roof so as to constitute a safety hazard. The apparatus includes a pedestal fixedly mounted to a structural element of the building and a mobile davit mount that includes both a davit socket and a safety line attachment point that is brought up to that pedestal, into an aperture of which is installed a base including a spring-loaded locking arm that removably attaches to a locking bar within the pedestal; a lock release attached to or a part of said locking arm can then be engaged to release the davit mount from the pedestal whereby the davit mount can be moved to another location on the roof.

6 Claims, 3 Drawing Sheets

Prior Art

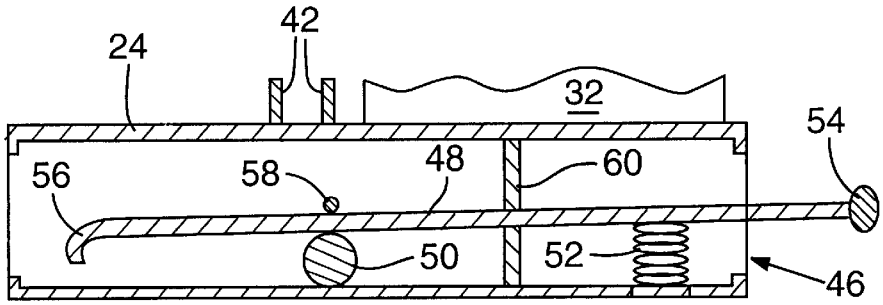
FIG. 10
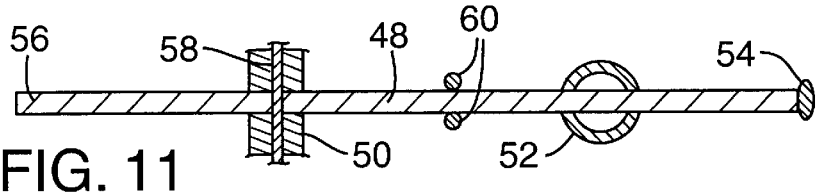
FIG. 11
FIG. 12
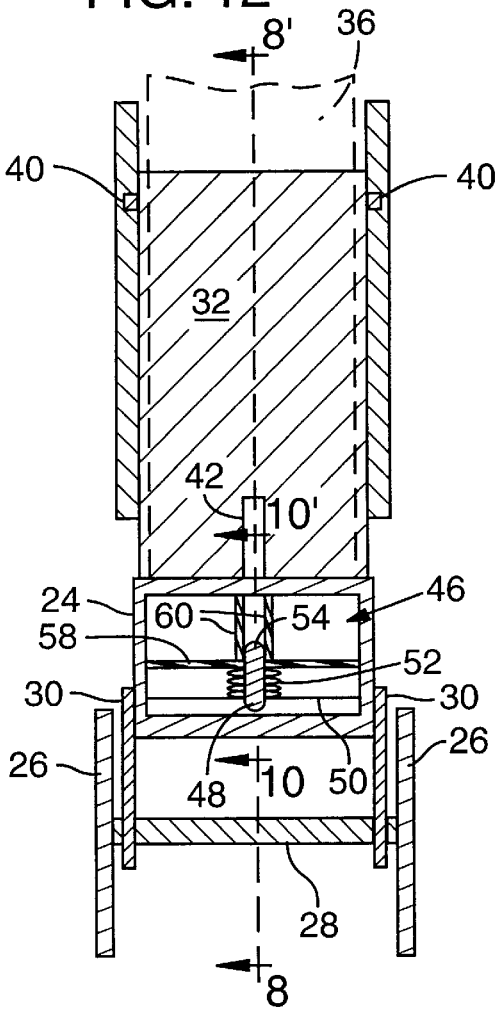
FIG. 13
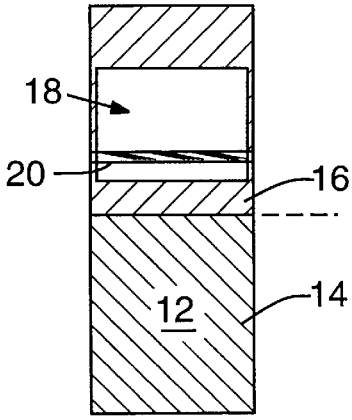

METHOD AND APPARATUS FOR SUSPENDING WORKER'S SCAFFOLDS OVER THE SIDES OF BUILDINGS

BACKGROUND OF THE INVENTION

1. Field of the Invention

This invention relates to methods and apparatus for suspending worker's scaffolds over the sides of buildings, towers, and the like for purposes of painting, window washing, maintenance, inspection or the like, particularly to such methods and apparatus that employ davits from which such scaffolds are to be suspended, and to methods and apparatus for securing the safety of such davits and of worker's scaffolds suspended therefrom, without compromising the integrity of a flat roof surface or a corresponding deck or the like in connection with which the davits are installed.

2. Background Information

For purposes of painting, window washing, maintenance, inspection or the like, it has been the practice to provide pairs of davits on the roofs of buildings, and from such davits there is suspended a scaffold that can be raised and lowered along the side of the building on which workers may stand to carry out their tasks. These davits are not permanent fixtures on a building; instead, socket pedestals are customarily provided around the periphery of the roof top, so that portable davit sockets can then be moved into such pedestals as the work may require, the davits then being placed into those davit sockets.

This general procedure is illustrated in FIG. 1 (prior art), which shows in schematic form a cross-section of one end of a building, including the roof top and parapet. Inboard from the parapet is a socket pedestal into which has been placed a davit socket (also shown separately to illustrate the wheels thereon), and one davit is shown inserted into the davit socket so as to extend beyond the building edge and permit suspension of a scaffold from a cable hanging down the side of the building. A safety line is also shown and exemplifies the need for the present invention.

Such safety lines are generally required, as set forth, e.g., in Title 8, General Industry Safety Orders, of the California OSHA regulations, p. 573, to ensure that in the event of disconnection of a scaffold from a davit, a second connection is made (or is accessible) between the scaffold and a structural location on the building. However, although the aforesaid disposition of structures in accordance with those regulations serves to provide for the safety of workers located on the scaffolding down along the side of the building, those same structures introduce substantial safety hazards to persons working on the roof top. Even in the absence of an installed davit socket and davit, for example, the socket pedestals will themselves present an obstacle extending perhaps a foot or so inwardly on the roof top from the parapet so as to create a hazard of tripping.

Such pedestals also act as an attractive nuisance, in that they are typically formed of one-inch steel plate, capable of bearing the weight of a person, and thus they create the temptation for persons to climb up and stand on them so as to come into danger of falling over the parapet. Again even in the absence of a davit socket and davit, some six feet or so inwardly from the socket pedestal there is associated therewith a safety anchor, which extends above the roof line to produce another tripping hazard. The safety anchor also introduces a substantial structural disadvantage in that a roof top that could otherwise be formed as a single, unbroken and leak-proof surface must have apertures formed therein so as to accommodate the safety anchors. It is difficult to maintain water-tight integrity between such upwardly extending structures and a flat roof top, hence the need for such a safety anchor introduces additional maintenance expenses. When the davit is installed it is necessary to use the safety line that connects back to the safety anchor, since the parapet itself is generally not a structural but only an add-on feature of the roof. The safety line then introduces additional hazard, not only for tripping, but a person walking near the periphery of the roof might well be "clothes-lined" by the safety line, by which is meant that when so walking in the dark a body could collide with the safety line.

Illustrative of the prior art in this field is U.S. Pat. No. 4,714,226 issued Dec. 22, 1987 to Tracy, which describes a "base member" (comparable to the socket pedestal noted above) mounted within the non-structural roof surface adjacent the roof parapet, a portable davit socket that can be wheeled into that base member and be removably mounted therein, and a davit that can be removably mounted into the davit socket. A particular feature of this device is that the davit socket incorporates a swivel, so that the socket can be rotated into a slanted position for easy insertion of the lower end of the davit, and then be rotated back to the vertical so as to hold the davit vertically.

U.S. Pat. No. 4,538,705 issued Sep. 3, 1985 to Leivestad addresses a different aspect of operating a davit-and-scaffold system, namely, the matter of moving the scaffold from an initial position atop the roof to its position when in use, i.e., suspended down the side of the building wall. For such purpose, the davit is made to be of a height such that the scaffold can be suspended therefrom at a position that is higher than the parapet, whereupon a stanchion apparatus permits the workers who have entered onto the scaffold to rotate the davits from which they are suspended outwardly from the building, until the scaffold is indeed positioned outwardly from the parapet and can be lowered as needed.

Another aspect of operating a davit-and-scaffold system lies in providing movement of the scaffold horizontally, along the building wall. This issue is addressed in U.S. Pat. No. 4,811,819 issued Mar. 14, 1989 to Sugiyama, wherein is described a set of mounting frames that are fixedly mounted to the roof parapet and to which is then attached a rail apparatus that permits horizontal as well as vertical motion of a scaffold (or "gondola") suspended therefrom. The use of such a device depends upon the parapet being structural in nature, i.e., it must be an integral part of the building structure and of a strength such that davits attached thereto need not have tiebacks or other such additional safety features added thereon. U.S. Pat. No. 5,343,979 issued Sep. 6, 1994 to Goto describes a similar device, likewise mounted to a structural parapet, that further includes a winch system for providing powered movement of the gondola.

As a means for mounting into some permanent building structure some vertical member, it is known for example to provide in the structure of a staircase an integral mount into which may be placed the "posts" of a stair rail. Such a device is described in U.S. Pat. No. 4,598,524 issued Jul. 8, 1986 to Cheng, wherein a U-shaped metal frame is nailed to a wooden form board around which is to be poured the structural concrete, so that when the concrete is set and the form board is removed, the aforesaid frame will have become integrated into the concrete base of the stairway, and the stair rail posts may be inserted therein. Such a procedure is not applicable to the removable mounting to a roof top of davits for the suspension of a workers' scaffold, however, since such a simple concrete structure is not adapted to withstand any substantial torque or moment of force (e.g., as would be caused by pulling the top of a stair rail in the Cheng device sideways) as is produced in a davit-and-scaffold system by the weight of the scaffold (and workers) pulling downward on the topmost and outward end of the davit.

What is needed and would be useful, therefore, is a method and apparatus for providing in the most common buildings that lack structural parapets the essential safety features with regard to persons working on a scaffold extending down the side of a building, without at the same time creating substantial hazards for persons working on the roof top of that building. It would also be of substantial value to provide such safety features without compromising the water-tight integrity of the roof top. The present invention serves both such purposes, as will now be described.

SUMMARY OF THE INVENTION

The invention comprises a method and apparatus for removably mounting sets of davits from which a workers' scaffold may be hung down the side of a building, such that a required safety line is provided without either presenting additional safety hazards to workers on a roof top or causing a break in the water-tight integrity of the roof top. In a preferred embodiment, the structural steel of the building itself is adapted for more convenient application of the invention, although such adaptation is not essential. In either case, a pedestal is fixedly mounted onto the structural steel of the building, and a mobile davit socket including a tie-in for a safety line is inserted into that pedestal, thus obviating any need for either a safety line that extends inwardly over a portion of the roof or a safety anchor located within the roof surface inwardly from the roof edge. The roof parapet, if required, can then be constructed around the aforesaid socket pedestal without interfering with the entry of the mobile socket davit and safety apparatus into that pedestal.

BRIEF DESCRIPTION OF THE DRAWINGS

The preferred embodiments of the invention will now be described in detail with reference to the accompanying drawings, in which:

FIG. 10 shows in a side, cross-sectional view taken along the lines 10–10' of FIG. 12 a docking lock assembly adapted for the locking of the mobile davit mount of FIG. 8 into the pedestal of FIG. 6, including a locking arm, pivot and springs.

FIG. 11 shows in top plan view the cooperation between the locking arm, pivot and springs of FIG. 10.

FIG. 12 shows the mobile davit mount of FIG. 8 in an end cross-sectional view, taken along the lines 12–12' of FIG. 8.

FIG. 13 shows an end elevation view of the pedestal of FIG. 4 taken along the lines 13–13' of FIG. 4.

DETAILED DESCRIPTION OF THE INVENTION

Figure 1:
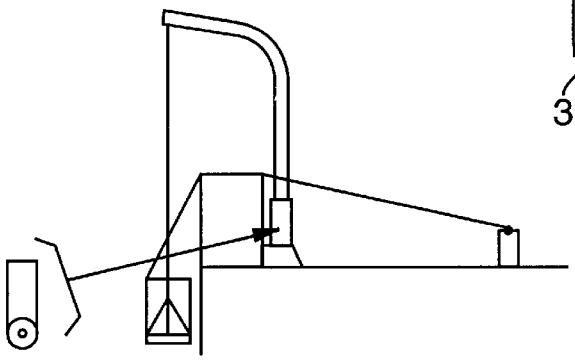
FIG. 1 Prior Art
FIG. 1 illustrates in schematic form an arrangement of components from the prior art for providing a scaffold hung from davits mounted on a roof top.
Figure 2:
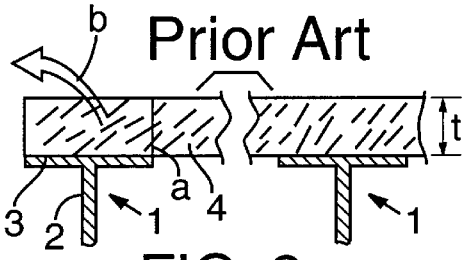
FIG. 2 shows in a side, cross-sectional view a method and apparatus from the prior art of laying a roof surface onto a structural steel member, but including a method of adapting such a pre-existing structure to the present invention.
Figure 3:
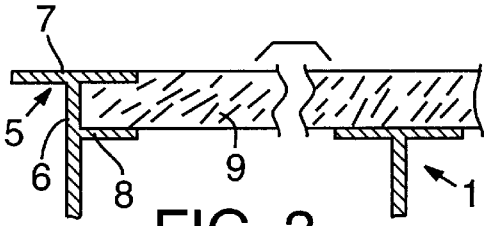
FIG. 3 shows in a side, cross-sectional view an adaptation of the structural beam itself of FIG. 2 for purposes of the present invention.

In order to relate the invention to a building structure, FIG. 2 shows in cross-section an arrangement of components from the prior art for hanging a scaffold from davits mounted on a roof top. A structural I-beam 1 that includes a vertical web 2 and a horizontal plate 3 is employed such that an end of roof 4 may be disposed thereon. In FIG. 3, an I-beam 5 modified to accommodate the invention includes a vertical web 6, a first plate 7 disposed across the top of the vertical web, and a second plate 8 that extends transversely on one side of web 6 and onto which an end of roof 9 is disposed, a portion of roof 9 having been cut away to accommodate first Plate 7 as a part of the structural steel of the building which then serves as a base for mounting the apparatus comprising the invention. As also shown in FIG. 2, access to a similar flat and square or rectangular plate that is a part of the structural steel of the building can be realized by "retrofit" in an existing building by merely cutting out the portion of roof material that lies leftwardly in FIG. 2 from a line a over the entire square or rectangle encompassed by horizontal plate 3 and removing the same as indicated by arrow b. (Inasmuch as the structures herein described are interspersed at pre-selected points along the edge of a building roof, roof 4 will continue to be supported vertically by beam 3 along the distance between installations of the present apparatus.) As will be noted below, the invention can be modified in accordance with whether in a particular installation the structural steel of the building has or has not been modified as shown in FIG. 3.

Figure 4:
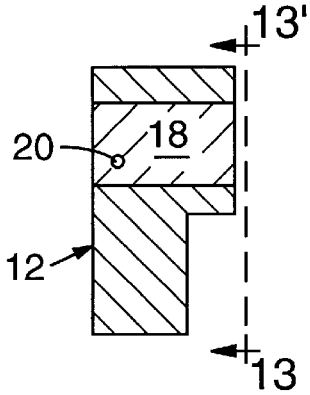
FIG. 4 shows a pedestal as employed in the invention in a side, cross-sectional view taken along the line 4–4' of FIG. 6.

With respect to the invention itself, FIG. 4 shows in a side, cross-sectional view a pedestal 12 in the form of a rather thick inverted "L" and having disposed through the length of the "foot" of the "L," i.e., horizontally through the lateral extension of the "L," a docking port 18 into which will be installed a mobile davit mount as will be hereinafter described. A locking bar 20 that extends transversely across docking port 18 serves to lock that davit mount in place.

Figure 5:
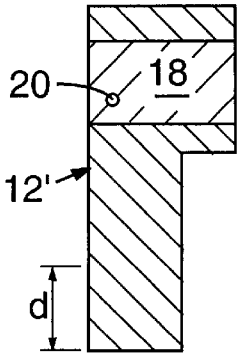
FIG. 5 shows in a side, cross-sectional view taken along the line 5–5' of FIG. 7 an adaptation of the pedestal of FIG. 4 for purposes of retrofitting onto an existing building.

FIG. 5 shows an embodiment of pedestal 12 of FIG. 4, designated as alternative pedestal 12', which has a greater height relative to that of pedestal 12 of FIG. 4 by an amount "d," the value of "d" corresponding essentially to the thickness of a roof, whereby pedestal 12' of FIG. 5 would be employed in the case of retrofitting to an existing roof as described above in connection with FIG. 2. Put briefly, in order to be used in conjunction with a mobile davit mount having a predetermined height as will be described hereinafter and intended for use with pedestals that both have and have not been retrofitted onto an existing building, a retrofitted pedestal must be of greater height if it is to be installed at a level corresponding to that of the lower surface of a roof rather than the level of the upper surface of the roof, that height being relatively greater by an amount corresponding essentially to the thickness of that roof.

Figure 6:
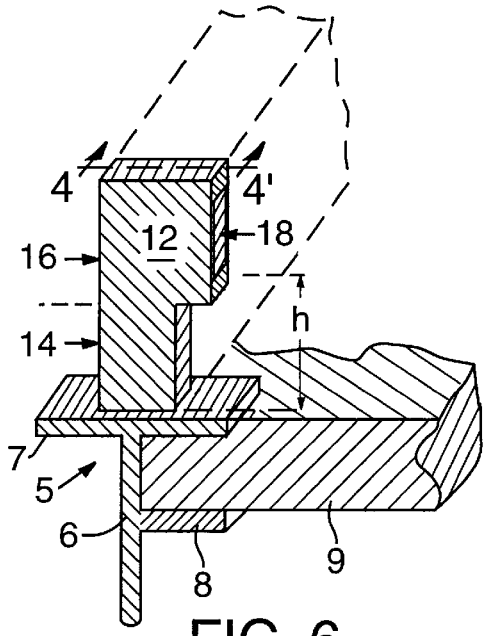
FIG. 6 shows in a perspective view the pedestal of FIG. 4 attached to the structural beam of FIG. 3.
Figure 7:
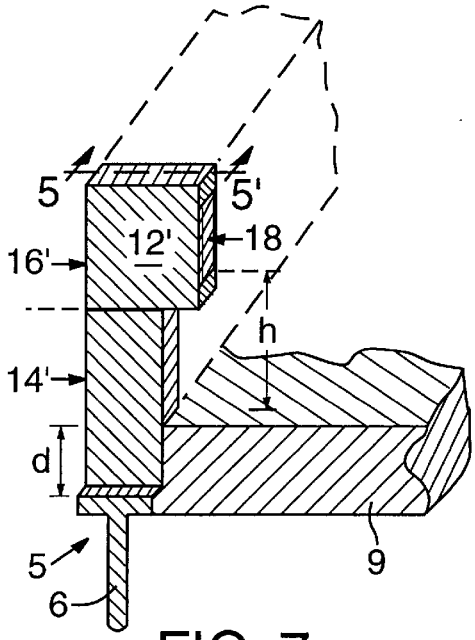
FIG. 7 shows in a perspective view the pedestal of FIG. 5 attached to the structural beam of FIG. 2, wherein some roof material has been removed for retrofitting purposes.

FIG. 6 shows in perspective pedestal 12 of FIG. 4 having been attached to plate 7 of FIG. 3 by welding or similar means. Pedestal 12 includes a relatively narrow stem 14 and a wider portion 16 through which passes docking port 18 as previously described. FIG. 7 similarly shows pedestal 12' of FIG. 5 and including corresponding narrow stem 14' and wider portion 16' installed onto plate 3 of FIG. 2, sufficient material from roof 9 having been removed to provide the required access thereto. (In the case of such a retrofit, corresponding portions of the parapet would also need to have been removed.) In both of FIGS. 6 and 7 there is shown a height "h" that represents the distance between the upper surface of the building roof and the lower side of docking port 18, wherein the value of "d" by which pedestal socket 12' exceeds pedestal socket 12 in length has been selected such that the value of "h" is the same in both drawings, i.e., a single mobile davit mount can be employed in relation to both types of pedestal.

Figure 8:
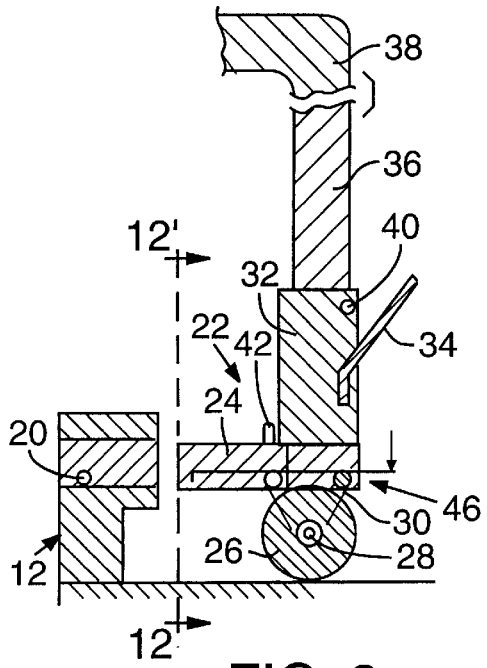
FIG. 8 shows in a side, cross-sectional view a mobile davit mount positioned for installation into the pedestal of FIG. 6.
Figure 9:
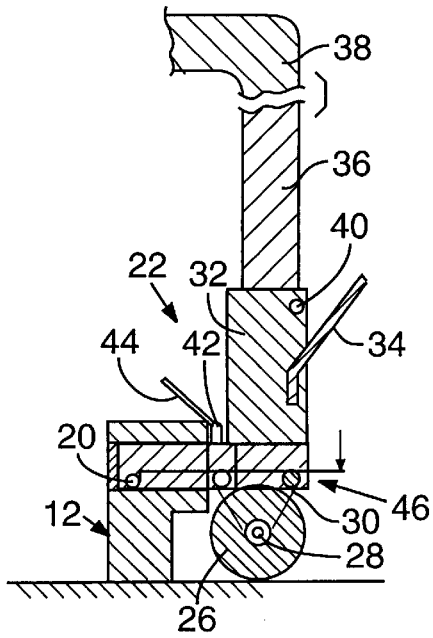
FIG. 9 shows the mobile davit mount of FIG. 8 having been installed into the pedestal of FIG. 6.

FIG. 8 shows in a side, cross-sectional view mobile davit mount 22 positioned for installation into pedestal 18 of FIG. 6. Davit mount 22 comprises a rectangular, box-like base 24 to which are attached wheels 26 (only one of a pair of which is shown in FIG. 8) by axle 28 and axle frame 30 that attaches to base 24 near to a first end of base 24. Extending upwardly from base 24, also near to the first end of base 24, is a davit socket 32, which comprises essentially an elongate hollow circular cylinder (in the case of a circular davit, or hollow rectangular box in the case of a rectangular davit) that is fixedly attached to a top surface of base 24 and is open at the end thereof opposite base 24. Handle 34 attaches to davit socket 32 facing outwardly from the first end of base 24 for convenience in rolling davit mount 22 about on wheels 26. Shown as having been inserted into davit mount 22 is a davit 36, a transverse extension 38 of which points outwardly opposite the direction of handle 34 towards the edge of the building. A locking pin 40 extends transversely across davit socket 32 for purposes of locking a davit therein when the same is installed as just described and shown. A safety tie 42 is provided atop base 24 to which will be tied or otherwise attached a safety line 44 as shown in FIG. 9. It is also conventional in making such connections to use a locking pin aperture at the point where connection is to be made, together with a line having a locking pin with attached cotter pin connected at the end thereof, so that once the locking pin is inserted into the locking pin aperture, insertion of the cotter pin through the locking pin prevents any accidental removal of that locking pin from the locking pin aperture. A docking lock mechanism 46 is incorporated within base 24 and is shown in greater detail in FIG. 10.

Specifically, FIG. 10 shows a longitudinal cross-section of base 24 taken along the lines 10–10' of FIG. 12, and includes a locking arm 48 that extends downwardly slantwise through the length of base 24. Locking arm 48 rests firstly atop a pivot 50, which may conveniently comprise a length of pipe disposed transversely across base 24 more or less centrally and at the interior bottom thereof, and secondly atop a set of springs 52 disposed near to the end of base 24 at which davit socket 32 is disposed. At the indicated end of base 24, locking arm 48 extends outwardly therefrom a sufficient distance to accommodate lock release 54 at the end thereof, and which consists essentially of a transverse rod shown as being elliptical in FIG. 10 but which can be of any convenient shape. A retaining bar 58 similarly extends transversely across base 24 just above pivot 50 and atop locking arm 48 so as to hold locking arm 48 down against pivot 50. The elements as just described are also shown in a top plan view in FIG. 11, which is taken in the direction 11–11' of FIG. 10, and FIG. 12 is a vertical end view of the entirety of mobile davit mount 22 taken in the direction 12–12' of FIG. 8, and which also shows in phantom a portion of a davit 36 inserted therein.

As shown especially in FIG. 10, the end of locking arm 48 opposite lock release 54 terminates in downwardly descending locking hook 56 that serves to engage locking bar 20 of either pedestal 12 of FIG. 4 or pedestal 12' of FIG. 5. The length of locking arm 48 is shown in FIG. 10 as being such that locking hook 56 at the end thereof comes to be disposed within base 24, but such a disposition is not necessary. That is, the length of locking arm 48 is predetermined in cooperation with the precise location of locking bar 20 within pedestal 12 of FIG. 4 or pedestal 12' of FIG. 5, so that when mobile davit mount 22 is brought up to either such pedestal, upon engagement of locking hook 56 with locking bar 20, davit mount 22 will have been disposed conveniently near to the particular such pedestal as shown in FIG. 9. FIG. 13 shows a vertical end view of pedestal 12 taken in the direction of lines 13–13' of FIG. 4, in order to show the transverse disposition therein of locking bar 20.

In operation, in an uncompressed state springs 52 have a greater height than does pivot 50, hence locking hook 56 will disposed at a lower height than that of locking release 54. Locking hook 56 has a degree of curvature at the distal end thereof such that upon mobile unit 22 being moved into one or the other of pedestal 12 of FIG. 4 or pedestal 12' of FIG. 5 so that locking hook 56 will come into contact with locking arm 20, locking hook 56 will be forced upwardly so as to pass by locking arm 20, which then causes compression of springs 52 inasmuch as upward movement of locking arm 48 as a whole is precluded by the contact thereof with retaining bar 58. Upon further movement of locking hook 56 past locking bar 20, the upward curvature of the inward surface of locking hook 56 then permits locking hook 56 to descend downwardly under the force of springs 52 to acquire the relative position shown in FIG. 9. Any movement of mobile davit mount 22 in the opposite direction away from either pedestal 12 of FIG. 4 or socket pedestal 12' of FIG. 5 is thus precluded by the engagement of locking hook 56 and locking bar 20.

A downward force exerted by an operator on lock release 54, on the other hand, will serve to disengage locking hook 56 from locking bar 20 by an opposite series of operations to those just described, hence by exertion of such a downward force, mobile davit mount 22 can be disengaged from either pedestal 12 of FIG. 4 or pedestal 12' of FIG. 5, perhaps to be moved to a different position on the roof.

Since locking arm 48 and locking hook 56 are shown in FIGS. 8–12 to be rather narrow, in order to preclude sideways movement of locking arm 48 it is advantageous to provide vertical bars 60 connected at opposite ends thereof to inner surfaces of base 24 on each side of locking arm 48. However, locking arm 48 can as easily be made quite wide so as to render any such sideways motion immaterial, and in that event a downward, disengaging force could be applied to an end thereof opposite locking hook 56, so that such a locking arm would itself include adequate surface for applying such a disengagement force, and inclusion of a lock release corresponding to lock release 54 would not be necessary.

It will be understood by those of ordinary skill in the art that other arrangements and disposition of the aforesaid components, the descriptions of which are intended to be illustrative only and not limiting unless specified as being essential, may be made without departing from the spirit and scope of the invention. For example, instead of a horizontal pipe, pivot 50 might well have a different structure such as a pair of rotatable bearings between would extend an axle on which a locking arm could be mounted, whereby both vertical and horizontal movement of such a locking arm would then be precluded, and elements such as retaining bar 58 and vertical bars 60 would not be required. In short, the main purpose of the invention, which is to allow the placement of davit sockets (and hence davits from which to hang a scaffolding) and the required safety lines in a manner that does not compromise the integrity of a roof surface, can be accomplished by other specific apparatus that are nevertheless within the spirit and scope of the invention, which must then be identified and determined only from the following claims and equivalents thereof.

what is claimed is:

1. An apparatus comprising:

a building having sides and an overlying roof defining an upper roof surface and a periphery and a periphery portion thereof surrounding said roof surface, a building support including a beam or column provided at said periphery portion and including a horizontal plate portion;

a pedestal permanently secured to the horizontal plate portion of the building support, said pedestal projected upwardly from the horizontal plate portion and upwardly of said roof surface to provide side walls above said roof surface, one of said side walls of the pedestal facing inwardly from the periphery and an opening in said one of said side walls of the pedestal that is above said roof surface and configured to define a lateral docking port extended into the pedestal; and a davit mount supporting a davit extended upwardly and outwardly relative to the davit mount, a base portion of the davit mount laterally and removably projected into the docking port of the pedestal.

2. An apparatus as defined in claim 1 wherein the davit is removably mounted to the davit support, a davit socket is provided in said davit support which defines an upwardly directed socket opening for removably receiving said davit.

3. An apparatus as defined in claim 2 wherein the davit mount is supported on a movable support for movement of the davit mount and davit across the roof of the building.

4. An apparatus as defined in claim 1 wherein the building support is at the extreme periphery of the roof, and an upwardly extended parapet provided on said roof at said periphery and providing an overcover at said support beam, said parapet provided with a cavity to receive said pedestal, said docking port exposed laterally from said parapet and directed inwardly of said periphery and without breaching said overcover provided by said parapet.

5. An apparatus as defined in claim 4 wherein the davit is removably mounted to the davit support, a davit socket provided in said davit support and defining an upwardly directed opening for removably receiving said davit, said davit socket on said davit mount when mounted to said pedestal being inwardly spaced from the horizontal plate and from said parapet for projecting the davit upwardly at a position inwardly of said parapet.

6. An apparatus as defined in claim 1 including a locking fixture releasably locking said base portion of said davit support in said docking port of said pedestal.

* * * * *